United States Patent [19]

Needham

[11] 4,051,693

[45] Oct. 4, 1977

[54] SELF-CONTAINED AIR-CONDITIONING UNITS

[75] Inventor: Frederick Johnston Needham, Auckland, New Zealand

[73] Assignee: McAlpine Prestcold Limited, Auckland, New Zealand

[21] Appl. No.: 621,211

[22] Filed: Oct. 9, 1975

[30] Foreign Application Priority Data

Oct. 18, 1974 New Zealand ..... 1175744

[51] Int. Cl.[2] ..... F25D 23/13

[52] U.S. Cl. ..... 62/262; 62/263; 98/94 AC

[58] Field of Search ..... 62/263, 262; 98/94 AC

[56] References Cited

U.S. PATENT DOCUMENTS

| | | | |
|---|---|---|---|
| 2,941,382 | 6/1960 | Wuesthoff | 62/262 X |
| 2,984,089 | 5/1961 | Whitsel | 62/262 X |
| 3,123,987 | 3/1964 | Moore | 62/263 |
| 3,552,139 | 1/1971 | Ulich | 62/262 |

*Primary Examiner*—Ronald C. Capossela
*Attorney, Agent, or Firm*—Wenderoth, Lind & Ponack

[57] ABSTRACT

An air-conditioning unit is positionable through a partition such as a wall. The unit has a housing passing through the wall and a plate covering the inner end of the housing. The evaporator coil is mounted on the plate. A further plate extends from the plate horizontally into the housing and the compressor and condenser are mounted on the further plate. An aperture leads through the first mentioned plate for the passage of air and leads to an elongated duct to provide sound attenuation. Sealing gaskets are provided between the housing and the first mentioned plate and sound deadening material is positioned to deaden sound on the housing and the first mentioned plate.

9 Claims, 3 Drawing Figures

SELF-CONTAINED AIR-CONDITIONING UNITS

BACKGROUND OF THE INVENTION

This invention relates to air conditioning units and in particular though not solely relates to air conditioning units which in use are mounted through a partition such as a wall or window such that part of the air conditioning unit is positioned outside a building and such that the remainder of the air conditioning unit is positioned within the building such that air can be drawn from inside or outside the building and then conditioned such that the air reaching inside the building provides a more comfortable environment for persons living or working within the building than would otherwise be the case.

Such air conditioning units at present available have been disadvantageous in particular in that the noise level from such air conditioning units and passed into the building is above that which is desirable. This noise arises in central as the component parts of the air conditioning unit are mounted on a chassis positionable within a housing in a manner such that the chassis may be removed in particular for servicing of the component parts. The component parts are usually placed on the chassis such that the evaporator is positioned within the room and such that the compressor and condenser are positioned outside the room. In this arrangement the noise arises principally from the compressor and the fans circulating air over the condenser but such noise is transmitted to the room by means of holes positioned within the chassis to allow air passage into the building and also for services such as refrigeration pipes.

Weather seals between the housing and the chassis also permit sound to enter the room. Sealing strips such as rubber strips along the sides of the chassis are used but this has proved ineffectual and has in fact provided a further noise path for noise arising from the compressor fans and also has provided a noise path for other noise arising outside the building such as traffic noise or other noises.

This problem has been compounded as the chassis generally sits on the bottom surface of a housing passing through the wall or window and the compressor and fans when operating cause the chassis to vibrate thus causing the chassis to knock against the housing giving rise to an uncomfortable and unpleasant noise particularly when metal to metal contact occurs. Attempts to damp such noise have also proved ineffectual.

SUMMARY OF THE INVENTION

It is therefore an object of the present invention to provide an air conditioning unit which will at least partially overcome the foregoing disadvantages in a simple yet effective manner of which will at least provide the public with a useful choice.

Accordingly the invention consists in an air conditioning unit including a housing positionable in an aperture through a partition such as a wall structure, a space dividing member positionable at or adjacent the end of the housing innermost in a building containing the wall structure. The space dividing member includes a ramp or inclined surface extending downwardly and outwardly, and the lower part of the housing has a rim formed therealong, such rim terminating in an inwardly turned portion forming a further ramp or inclined surface such that the space dividing member may be positioned into or over the housing in a manner such that the ramp of the space dividing member engages the ramp of the housing such that as the space dividing member is inserted into or onto the housing the engagement of the two ramps draws the space dividing member closely against parts of the housing so as to substantially provide a seal between the inside and outside of the building. At least one aperture extends through the space dividing member for the passage of air and services. The space dividing member has mounted thereon a compressor, a condenser, and an evaporator.

Preferably, the space dividing member comprises a plate positioned substantially vertically in use and an extension to the plate positioned substantially horizontally and extending from the plate into the housing in use. The compressor and condenser are mounted on the extension of the plate forming the space dividing member such as to provide forces about the point of engagement between the two ramps, which forces tend to draw the plate to the housing.

Preferably the condenser and compressor are mounted on the outside of the space dividing member, and the evaporator is mounted on the face of the space dividing member facing inwardly of the building.

Preferably the aperture or apertures through the space dividing member leads to an elongated duct mounted on the space dividing member. Air passing from the outside to the inside of the building passes through such aperture or apertures through the space dividing member and also along the elongated duct.

Preferably the elongated duct is positioned on the inwardly facing face of the space dividing member.

Preferably the space dividing member is positioned over the innermost end of the housing and when inserted abuts against such housing end to form a seal therewith.

Preferably sealing means are provided between the space dividing member and the end of the housing.

Preferably such sealing means comprises a gasket positioned on the space dividing member or the housing, such gasket being positioned to engage the housing or the space dividing member.

Preferably the air conditioning unit further includes a casing positionable over the innermost end of the housing, such casing covering the evaporator part of the air conditioning unit and providing a further passageway for air passing from the outside to the inside of the air conditioning unit.

Preferably the casing is positioned so as to engage the top edge of the evaporator, the elongated duct leading into a space below the evaporator so that air must pass through the evaporator before passing from the casing.

To those skilled in the art to which this invention relates many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWINGS

One preferred form of the invention will now be described with reference to the accompanying drawings in which.

DETAILED DESCRIPTION OF THE INVENTION

Figure 1:
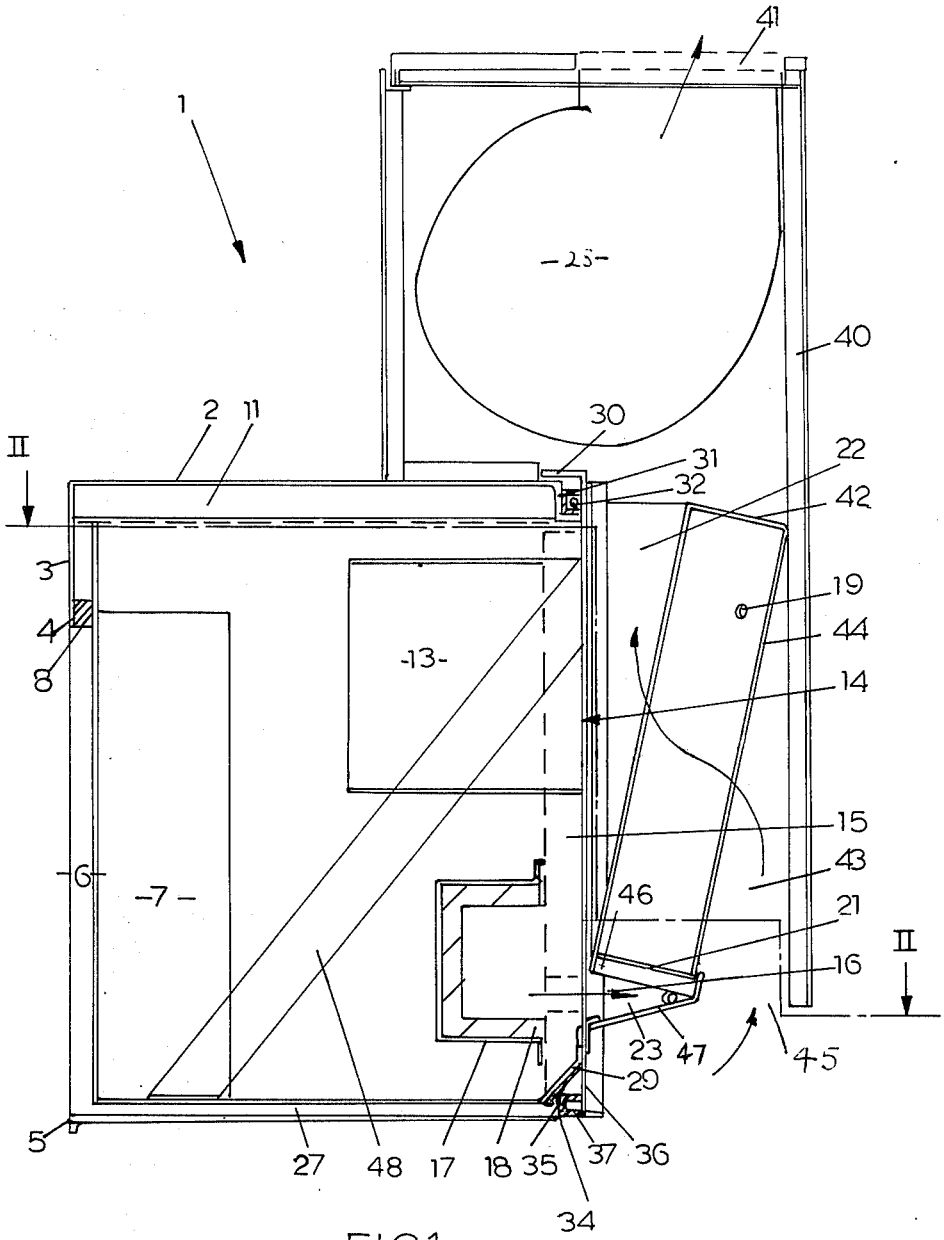
FIG. 1 is an elevation view diagrammatically showing an air conditioning unit according to the invention.

An air conditioning unit 1 according to the invention includes a housing 2 which is positionable in a partition preferably in the exterior wall or exterior window of a building such that part of the housing 2 is positioned inside the building. The housing 2 may be constructed of any suitable material but preferably is constructed of sheet metal pressed or formed to the desired shape.

The upper outer end 3 of the housing 2 may be turned downwardly such that the bottom edge 4 of the downturned end 3 of the housing and the bottom part 5 of the housing 2 co-operate to form an opening 6 through which air may pass, for example heated air from a condenser coil 7. Suitable seals 8 of material such as foam are preferably provided around opening 6.

A further opening 9 is provided in the housing through which air to be conditioned is drawn for example by a fan 10 driven by a motor 10*a* such as an electric motor.

The inner walls of the housing 2 may be provided with sound deadening material 11 particularly along the top and side surfaces as shown in the figures. A dividing plate 12 is provided along the housing 2 through which an aperture 13 is provided.

The dimensions of the housing may be any suitable size but by way of example only the housing could be about 15½ inches high, about 35 inches wide and about 13 inches long. Such a construction would generally be such that about 8 inches of the construction is positionable in the partition and extended through the partition.

A space dividing member 14 is provided which preferably comprises a plate which may have sound deadening material 15 positioned on one side, preferably the outwardly facing side thereof, and an aperture or apertures are provided through the space dividing member 14 for example aperture 16. A duct 17 may be provided which may have sound deadening material 18 on the inner surfaces thereof such that air passes through an entrance way into duct 17 before passing to the aperture 16.

Figure 2:
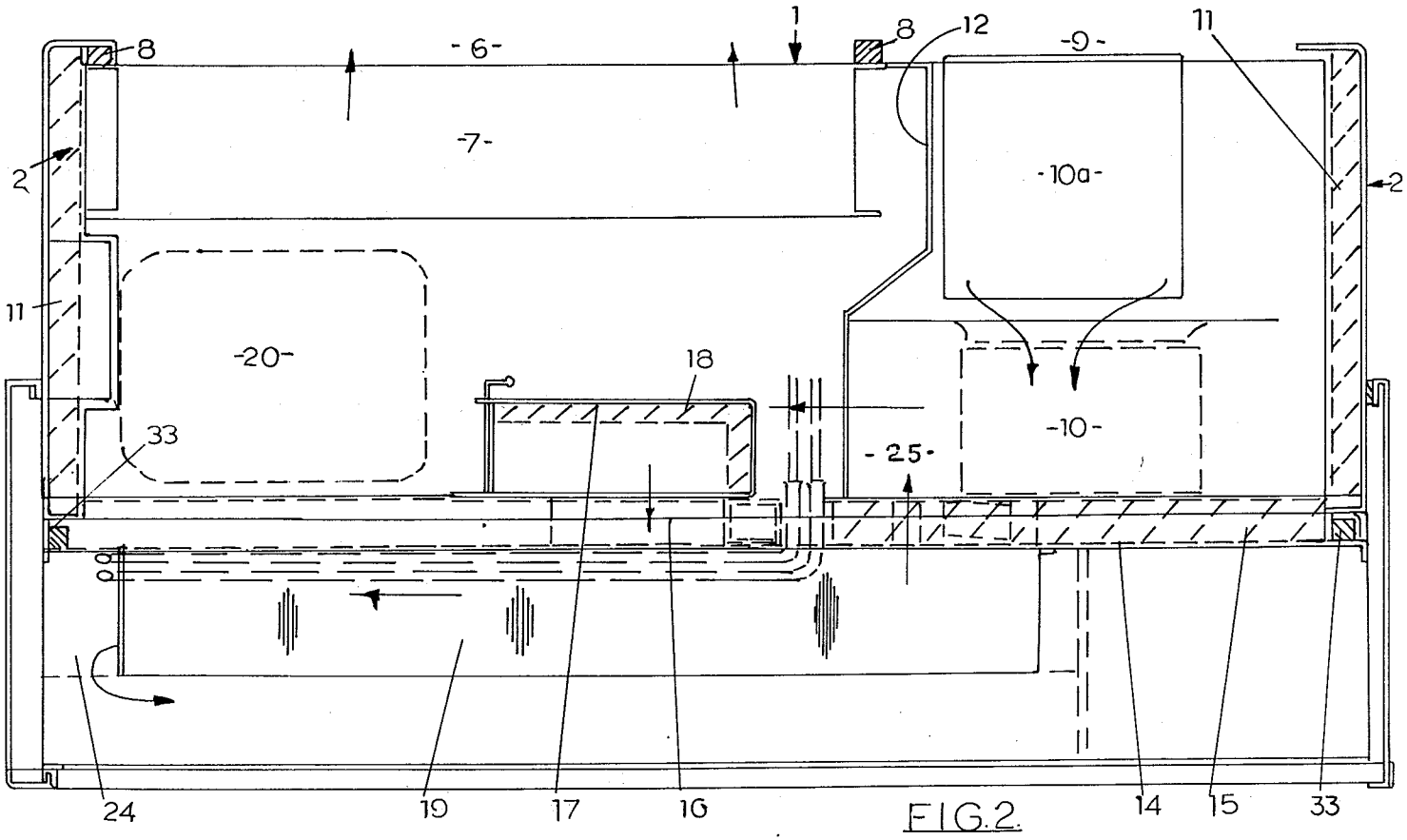
FIG. 2 is a section view of the air conditioning unit shown in FIG. 1, taken along line II—II of FIG. 1.

The space dividing member 14 has mounted thereon the evaporator 19, the condenser coil 7 and the compressor 20. The evaporator 19 is preferably positioned on the inwardly facing face of the space dividing member 14 and may be mounted on a bracket or plurality of brackets engaged on that face of the space dividing member 14. Thus a bracket 21 may be provided upon which the bottom edge of the evaporator sits and also further brackets 22 may be provided such as to support the evaporating coil. The evaporating coil may be positioned substantially vertically or may be tilted as shown in FIG. 1. The bottom bracket 21 is preferably substantially in the form of a plate positioned above the aperture 16 and a further plate may be positioned below the aperture 16 the further plate being plate 47. The plate 21 and the plate 47 are engaged to form a duct 23 preferably an elongated duct over which an end plate may be placed such that an outlet from the duct 23 is provided at the point 24, for example, as shown in FIG. 2. The duct 23 may be such that the air is passed through the aperture 16 and along the duct 23 and also provides a passageway for piping and cabling, for example, for electric supply to the motor 10*a* and, for example, for condensate to be passed to a drain 25. Insulation 46 may be provided in the duct 23. The duct 23 may be open at one end to provide the largest acoustic path length or may be open at each end with aperture 16 leading to substantially a mid-point thereof.

The space dividing member 14 preferably includes a supporting plate 27 engaged at or adjacent the lower end of the space dividing member 14, which plate 27 is adapted to be positioned over the end of the housing 2. The plate 27 is preferably joined to the space dividing member 14 by means of a ramp or inclined member 29 on the lower surface of which may be positioned a cushioning and/or sound deadening material such as a felt material.

The plate 27 preferably does not rest on the bottom surface of the housing 2, but supporting material such as rubber strips or sound deadening material such as lead impregnated vinyl may be positioned therebetween if desired although an air gap is preferred.

Side supports 48 may be provided between the plate 27 and space dividing member 14 if desired, and preferably are provided.

The space dividing member 14 is preferably formed such that a rim may be provided on at least the top edge, e.g. at 30, which overlaps the end of the housing 2, and the housing 2 preferably has an inturned edge 31 such that sound deadening or vibration preventing material such as moulded rubber in a strip 32 may be placed therebetween. Such strip is also preferably positioned down the sides of the space dividing member 14 as shown at 33 in FIG. 2. A sealing means between the dividing member 14 and the end of the casing is provided and the sealing means preferably comprises the strip 32 and 33 above described.

Figure 3:
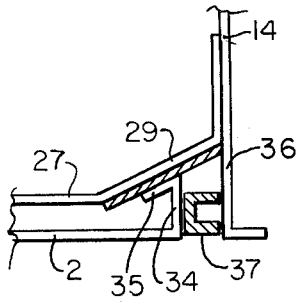
FIG. 3 is an enlarged view of a portion of the structure shown in FIG. 1.

The bottom surface of the housing 2 is preferably formed to a rim 34 which has an inwardly and downturned edge 35 providing a surface of the casing against which the ramp 29 may bear, as shown in FIG. 3.

The conditioning coil 7 and compressor 20 are preferably mounted on the plate 27 so as to provide a substantial weight on that plate.

The space dividing member 14 is preferably positionable in the housing 2 by inserting the plate 27 into the housing 2 at a height above the position where it will eventually be placed and pushing it in until the ramp 29 begins to slide downwardly over the edge 35. As this happens the lower extension 36 of the dividing member 14 will drop into the position shown in FIG. 1 and will be sealed to the end of the housing by means of a gasket 37 preferably of the type shown at 32 and 33. The weight of the conditioning coil 7 and compressor 20 will cause the space dividing member 14 to rotate about the engagement of the two ramps and in FIG. 1 this rotation will be in a counter-clockwise direction until the sealing strips 32 and 33 come against the end of the casing, thus preventing further movement. In order to withdraw the space dividing member 14 the reverse procedure is performed. As an alternative, a channel member could be provided on the space dividing member or the housing to engage a rib or the like on the other of these structures.

The air conditioning unit may also include a casing 40 which passes over the evaporator coil 19 and duct 23 and which may also include fans 28 to direct air through an aperture, for example, an aperture as shown at 41. Also, heating coils (not shown) may be provided within the casing 40. The top edge of surface 42 may rest against the housing 40 as shown in FIG. 1 so that air passing from the duct 23 and room air from gap 45 passes into chamber 43 and is then substantially forced to pass through the evaporator coils 19 by fans 28 before passing to aperture 41. A filter 44 may be provided adjacent the evaporator coils 19.

The sound deadening material 11 and 15 may comprise a suitable material such as lead impregnated vinyl.

The refrigeration circuit is also completed by, for example, providing suitable control valves between the evaporator and condenser.

The use of the invention is as follows:

In use a suitable aperture is provided in a partition such as a wall or a window and the housing 2 fitted therein. The casing 40 is preferably removable from the housing 2 and may be fixed as desired.

When put in operation the motor 10a drives the fan 10 and air is drawn in through the aperture 9 and passes through aperture 13 and out over coil 7. Some air also passes through duct 17 and aperture 16 to the elongated duct 23 and from the end of the elongated duct 23 to mix with room air from gap 45. The mixed air passes through the evaporator coils 19 to aperture 41 and out into the room. Noise from the compressor 20 and motor 10a is substantially prevented from entering the room by means of the sound deadening material 11 and 15 and also the sealing gaskets 32, 33 and 37.

Sound passing through the aperture 16 is attenuated by means of the ducts 17 and 23 and, in particular, the elongated duct 23 through which the sound passes. The elongated duct 23 also provides a suitable passageway for piping and cabling which must be led from the room to the outer parts of the casing 2.

In order to service the apparatus the housing 40 is removed and the space dividing member 14, the plate 27 and all equipment mounted thereon may then be readily removed in the manner above described and replaced when servicing is completed.

Thus, it can be seen that an air-conditioning unit is provided which will still allow servicing to be carried out in a simple yet effective manner from inside the building, but which will provide for substantial reduction in the noise passing from the outside of the building to the inside. Vibration of the condenser and motor is also substantially prevented as the motor and compressor are mounted on a plate which is substantially not in contact with the casing and thus, in particular, metal to metal contact is avoided.

The air-conditioner also provides full weather protection and a substantial fire rating by virtue of space dividing member 14.

I claim:

1. An air conditioning unit comprising:

a housing positionable in an aperture through a partition such as a wall structure of a building;

a space dividing member removably positioned adjacent the end of said housing which is innermost within said building;

said space dividing member having an inclined first surface extending downwardly and outwardly from said building toward said housing;

said housing having an upwardly extending rim terminating in an inwardly and downwardly second surface;

said inclined first surface engaging over said inclined second when said space dividing member is positioned adjacent said innermost end of said housing, said inclined first and second surfaces cooperating to form means, as said space dividing member is inserted toward said housing, for drawing and urging said space dividing member toward said housing to form a seal therebetween and between the exterior and interior of said building;

said space dividing member having therein at least one aperture for the passage therethrough of air; and said space dividing member having operatively mounted thereon a compressor, a condenser and an evaporator.

2. An air conditioning unit as claimed in claim 1, wherein said space dividing member comprises a first plate positioned to extend substantially vertically when in use, and a second plate attached to said first plate and extending substantially horizontally therefrom into said housing when in use, said compressor and condenser being mounted on said second plate within said housing and providing forces to urge said space dividing member about the point of engagement between said first and second surfaces to urge said first plate toward said housing to form said seal.

3. An air conditioning unit as claimed in claim 2, wherein said evaporator is mounted on the face of said first plate of said space dividing member facing inwardly of said building.

4. An air conditioning unit as claimed in claim 1, wherein said aperture through said space dividing member leads to an elongated duct mounted on said space dividing member, air passing from the outside to the inside of said building passing through said aperture and along said elongated duct.

5. An air conditioning unit as claimed in claim 4, wherein said elongated duct is positioned on the face of said space dividing member facing inwardly of said building.

6. An air conditioning unit as claimed in claim 5, further comprising a casing positioned over the innermost end of said housing, said casing covering said evaporator and providing a passageway for air passing from the outside to the inside of said air conditioning unit.

7. An air conditioning unit as claimed in claim 6, wherein said casing is positioned so as to engage the top edge of said evaporator, said elongated duct leading into a space below said evaporator so tht air must pass through said evaporator before passing from said casing.

8. An air conditioning unit as claimed in claim 1, wherein said space dividing member is positioned over the innermost end of said housing ad when inserted abuts against said end to form said seal.

9. An air conditioning unit as claimed in claim 8, wherein sealing means are provided between said space dividing member and said end of said housing, said sealing means comprising a gasket positioned on one of said space dividing member and said housing and engaging the other of said housing and said space dividing member.

* * * * *

UNITED STATES PATENT AND TRADEMARK OFFICE

CERTIFICATE OF CORRECTION

PATENT NO. : 4,051,693

DATED : October 4, 1977

INVENTOR(S) : Frederick Johnston NEEDHAM

It is certified that error appears in the above-identified patent and that said Letters Patent are hereby corrected as shown below:

Claim 1, line 59, before "second" insert -- inclined --;

Claim 1, line 62, after "second" insert -- surface --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*